US008070371B2

(12) United States Patent
Campanini

(10) Patent No.: US 8,070,371 B2
(45) Date of Patent: Dec. 6, 2011

(54) LIMITING DEVICE FOR ROLL PRINTERS

(75) Inventor: Alberto Campanini, Fidenza (IT)

(73) Assignee: Custom Engineering SpA, Fontevivo (Parma) (IT)

( * ) Notice: Subject to any disclaimer, the term of this patent is extended or adjusted under 35 U.S.C. 154(b) by 945 days.

(21) Appl. No.: 11/960,959

(22) Filed: Dec. 20, 2007

(65) Prior Publication Data

US 2008/0229892 A1 Sep. 25, 2008

(30) Foreign Application Priority Data

Mar. 21, 2007 (EP) ..... 07425170

(51) Int. Cl.
*B41J 11/00* (2006.01)
*B65H 43/00* (2006.01)
*B26D 7/06* (2006.01)

(52) U.S. Cl. ..... 400/621; 400/578; 400/586; 400/611

(58) Field of Classification Search ..... 400/578, 400/586, 611, 621; 226/10; 83/75, 79
See application file for complete search history.

(56) References Cited

U.S. PATENT DOCUMENTS 6,056,460 A * 5/2000 Suzuki ..... 400/621
6,143,105 A * 11/2000 Nash et al. ..... 156/64
6,428,226 B1 * 8/2002 Suzuki et al. ..... 400/642
7,322,760 B2 * 1/2008 Campanini ..... 400/611

* cited by examiner

*Primary Examiner* — Leslie J Evanisko
*Assistant Examiner* — Marissa Ferguson Samreth
(74) *Attorney, Agent, or Firm* — J. Harold Nissen; Lackenbach, Siegel

(57) ABSTRACT

A limiting device to prevent unwanted removal of paper from a paper or ticket printing and dispensing apparatus for paper roll printers, including paper cutter actuating means, positioned between a ticket dispensing exit and a cutting device to cut paper onto which printing has taken place and for controlling feeding of the paper and for controlling operation of the printer; activation of the cutting device is responsive to either an incompletely printed ticket or an action externally of said apparatus or to completion of any printing onto the ticket; a movable member or curved door is provided to more from a deactivation position to an activation position to control the operation of the paper cutter and the curved door is responsive to completion of a ticket printing operation or an occlusion at the dispensing exit or to a pre-set printing operation.

15 Claims, 7 Drawing Sheets

LIMITING DEVICE FOR ROLL PRINTERS

FIELD OF THE INVENTION

This invention is concerned with a limiting device or exit bunching device for printed tickets.

DESCRIPTION OF PRIOR ART

As is well known, if there is any interference with a ticket printing apparatus, the internal operation can be damaged or harmed, and the resultant printed paper is damaged or the printing information printed thereon may be incorrect and further possible jamming of the apparatus may take place.

It should be noted that when devices for printing of vouchers are located in places or situated in situations where the public is involved, quite often the paper or voucher is taken out or removed prematurely while the machine is still in the printing phase or the paper or voucher is pulled or withdrawn when a partially printed ticket is being dispensed. Therefore, an incorrect or inaccurate printing of the same paper voucher together with an inevitable jamming of the apparatus or mechanism may effectively comprise the working or operation of the same device or apparatus for the present as well as following or subsequent vouchers. There is also the possibility, in fact, that the user may take or hold an end of the paper when a partially printed ticket is exiting, and one may remove or take out the same paper from the printer apparatus while the printer apparatus is still in its printing phase or immediately at the end of the printing phase, to provide an incorrect or improper print and/or an excessive use and wastage of paper.

Currently, heretofore known paper ejection devices or trays mounted into printers of this type, provide, at their exit or discharge opening collection which form part of or which are in sequence from the printer and from a decollator or multiphase copy collector and a positioning of a paper strip between printer rolls and rolls to move the paper, an electronic or mechanical clutch may be provided, which is used for the issuing or dispensing of an already cut voucher and separated from the primary paper supply roll from which the vouchers are obtained. In these devices or apparatuses, at least two of the rolls onto which the paper runs are connected to an electric motor to drive the advancement of the paper towards the exit.

In these known paper ejection devices, there may also be provided a sensor to stop or prevent the paper or voucher from advancing in the case of an incorrect operation, such as a forced or unanticipated paper removal, in comparison with foreseen problems or desired times to provide sufficient time for printing of the ticket, the appropriate time period provided for the cutting and for the advancement of the paper to the exit. These known devices also have a proper intrinsic complexity in connection with the use of an electric motor, of rolls with electronic clutch and of sensors connected to retroaction systems.

These known devices also have consequently high industrial costs and possibility of breakdown of the components.

SUMMARY OF THE INVENTION

The invention refers to a new and original device capable of avoiding the above-noted problems, and at the same time to provide a simple and inexpensive apparatus for the printing of tickets and vouchers which is capable of overcoming some problems which may be inherent in the apparatus and others due to human unwanted intervention.

The invented device, in fact, provides for a reduction in the number or quantity of required components and the components actually used to carry out the invention usually have low industrial costs.

The invented device essentially includes a curved door capable of rotation around or about pins or an axle and placed onto a frame of the printing apparatus for enclosure of the operating printing and ticket dispensing mechanisms or devices. The door is equipped or provided with underlying springs positioned on its underside when in a closed condition and near the door's curved position.

The spring is preferably positioned closer to the edge of the door connected to the pins or axle about which the door rotates freely. A switch is placed onto the frame and in contact with the curved door, and the switch is responsive to movement of the door. The switch is connected to the cutting device for cutting of the voucher or paper onto which information is to be printed and to activate a cutter or device to cut the ticket or voucher based on the time pre-set and a controlled time interval to provide a correct or accurate printing of the ticket. In this way, the cutting device is activated solely in response of a completely printed ticket. The printing apparatus is also responsive to an incompletely printed ticket due to an occlusion at the exit opening or to a pulling at the exit opening to stop the printing and prevent the printing of an incorrectly printed ticket. If tension is applied to the ticket or voucher so that it is pulled by an outside source and not by the pulling device of the machine, while the printing apparatus is still in the printing phase or before the printing is completed or ended, the improperly or incompletely printed ticket or voucher is out, and the printing operation is stopped, and the paper or voucher conveyor means for moving the paper or voucher is stopped, and the improperly printed ticket or portion thereof can be removed to avoid jamming and the printing operation can be resumed. Therefore, a correctly printed ticket or voucher is always provided because the apparatus is allowed to complete its operation or stopped if a ticket is not completed and printed correctly and completely.

The door is responsive to an external pulling of the ticket or voucher from the apparatus to activate the switch to cut off operation of the machine, and thereby avoid jamming and paper wastage. The operation of the machine is timed so that each ticket is properly printed before being discharged through the opening or ticket exit, and any interference with the exiting ticket whether by pulling the ticket forward or holding the ticket back or preventing the ticket from exiting will activate the door switch and immediately stop the apparatus, and the partially printed ticket and prevent the apparatus from jamming and providing for excess paper usage.

To these ends, the present invention consists in the provision of a limiting device for preventing or limiting of paper removed from a roll printer apparatus free of electric motors and associated with rolls responsive to an electronic clutch and sensors connected to retroaction systems, and includes a curved door capable of rotation around pins and having one end coupled to the pins for coupling the curved door to a frame forming part of the apparatus, with the curved door being equipped with a pair of underlying springs, connected to the frame and provided for fixing or attaching the springs at one end thereof to the frame with attachment means and with the other end of each spring underlying the curved door capable of exerting pressure onto the underside of the curved door while permitting the curved door to rotate about the pins, and with a second part or free end of the door remote from the one end being free to rotate a normal or inoperative position to an operative position, a switch associated with the frame and in contact with the curved door and responsive to the movement of the door from its inoperative position to its operative position in order to activate the switch, and with the switch being connected, through or by means of a cable, to a paper or voucher cutting device which is activated in response to tension applied the paper in response to the door being moved to its operative position.

The limiting device can also be provided with a sensor device instead of the switch and placed in the same position as the switch. The sensor device would then be responsive or activated in response to the door movement to its operative position in response to tension applied to the paper to cause the door to move to overcome a holding action by the springs to hold the door in its inoperative position.

Specifically, this invention is primarily concerned with a limiting device to prevent unwanted removal of paper from a paper or ticket printing and dispensing apparatus for paper roll printers or interference with the printing and dispensing apparatus, and the apparatus includes a paper roll for dispensing paper onto which printing is to take place, the apparatus includes means for feeding paper from the paper roll to a paper or printed ticket dispensing exit after printing onto the ticket, a paper or ticket printing printer positioned between the paper roll and the ticket dispensing exit, a paper or ticket cutting cutter or device is provided and positioned between paper ticket printer and the ticket dispensing exit, and the limiting device according to the invention includes a paper cutter actuating device or means positioned between the ticket dispensing exit and the paper cutting device for activation of the paper cutting device to cut the paper onto which printing has taken place and preventing further feeding of the paper and for preventing further operation of the printer. The activation of the cutting device to cut the paper is activated in response to an incompletely printed ticket or in response to an action externally of the apparatus when there is an occlusion or some other interference at the ticket dispensing exit which prevents the paper exiting from the dispensing exit to prevent withdrawal of the paper or a partially printed ticket prior to completion of any printing onto the ticket in response to the external occlusion or interference with the paper at the exit opening, and the paper actuating means includes a movable member associated with the ticket cutter to cut a partially or incompletely printed ticket movable from a first or deactivation position at which the ticket cutter does not cut the paper ticket to a second or activation position to render the ticket cutter operable so that the ticket cutter will automatically and substantially immediately after the interference render the ticket or paper cutter active to cut the partially or incompletely printed paper ticket in response to the external interference with the paper at said exit opening, and the actuating means is also responsive to a completion of a ticket printing operation in response to completion of the intended printing onto the paper ticket for cutting the completely printed paper ticket so as to permit withdrawal of the completely printed ticket and cut ticket from the exit opening.

The activation means includes a pivotal door member having a pair of spaced ends, one of said spaced ends being a free end and positioned at the exit opening and the other of the spaced ends being pivotally connected with the apparatus frame and positioned between the exit opening and proximate to the cutting device. The door pivotable member is pivotable and movable relative to the frame for deactivation of the ticket cutting cutter and signal forwarding means is provided for sensing a signal in response to the external interference at the exit opening to send a signal to the printing device to stop any printing onto the paper and to activate the cutting device to cut the ticket before the ticket or paper has been fully and completely printed to prevent bunching of paper from the paper roll or a partially printed ticket at the exit opening.

The signal forwarding means includes a switch activated in response to the pivotal door member being moved and pivoted in a direction relative to the switch for activation thereof, and the switch upon activation forwards a signal to the cutting device and the printer apparatus for activating the cutting device to render the cutting device operative to cut the partially printed paper or ticket and to deactivate the feeding means to prevent any further feeding of paper so as to avoid any bunching at the exit opening.

The signal forwarding means includes a sensor responsive to movement of the door pivotal member to deactivate the printing device and to activate the cutting device to cut the paper or partially printed ticket.

A spring holding means or device is provided with one end connected with the frame and another end fixed to or pressure engaged with an underside of the door pivotal member for maintaining the door pivotal member in a non-activating or non-operating position, and the spring holding means is responsive to any external interference with the paper at the exit opening during operation of the ticket printing operation to move the pivotal door member as a partially printed ticket passes over the door pivotal member moving towards the exit opening and overcoming the spring tension or pulling on the underside of the door pivotal member to permit movement of the pivotal door member to its fully extended position for activation of the signal forwarding means to deactivate the paper feeding means and to stop the ticket printer and to sever any partially printed paper or paper ticket, thereby to prevent bunching of paper at the exit opening.

A cable is coupled with the signal forwarding means, the paper or ticket printing device and the cutting device for transmitting the signal to the printing device and to the cutting device upon activation in response to the movement of the pivotal door member from its normal position or inoperative position when the springs move the pivotal door member to its operative position or to a non-printing operation condition, and pivotal upon release of the tension or pulling action placed onto the pivotal door member by the springs.

The pivotal door member can also be considered to be and function as an external arm cover for said apparatus.

The signal which is responsive to the external interference at the exit opening senses when an interference takes place at the exit opening for sensing a signal to send an indication to the printing device to stop printing onto the paper and to activate the cutting device to cut a partially printed ticket to prevent bunching of paper from the paper roll at the exit opening.

List of Alberto Campanini Applications and Patents

The inventor of this application also has patents and applications in this field of technology, and these are as follows:

Re: U.S. Pat. No. 6,798,436, issued: Sep. 28, 2004 on application U.S. patent application Ser. No. 10/147,174, Filed: May 8, 2002

Title: THERMAL PRINTER CLOSING APPARATUS

Re: U.S. Pat. No. 7,175,356, issued: Feb. 13, 2007 on U.S. patent application Ser. No. 10/939,043, Filed: Sep. 10, 2004

Title: HEAD SUPPORT BASE FOR THERMAL PRINTER

Re: U.S. patent application Ser. No. 11/272,277, Filed: Nov. 10, 2005

Title: LASER WRITING HEAD FOR PRINTER

Re: U.S. patent application Ser. No. 11/193,214, Filed: Jul. 29, 2005

Title: ANTIJAMMING DEVICE FOR PRINTERS PUT IN PUBLIC PLACES

Re: U.S. patent application Ser. No. 11/581,880, Filed: Oct. 16, 2006

Title: AUTOMATIC OPENING DEVICE FOR THE PAPER LOADING INTO THE PRINTERS

Re: U.S. patent application Ser. No. 10/147,174, Filed: May 8, 2002,

Title: THERMAL PRINTER CLOSING APPARATUS

Re: U.S. patent application Ser. No. 10/939,044, Filed: Sep. 9, 2004,

Title: HEAD SUPPORT BASE FOR THERMAL PRINTER.

Re: U.S. patent application Ser. No. 11/272,277, Filed: Nov. 10, 2005,

Title: LASER WRITING HEAD FOR PRINTER.

Re: U.S. patent application Ser. No. 11/193,214, Filed: Jul. 29, 2005,

Title: ANTIJAMMING DEVICE FOR PRINTERS PUT IN PUBLIC PLACES.

Re: U.S. patent application Ser. No. 11/581, Filed: Oct. 16, 2006,

Title: AUTOMATIC OPENING DEVICE FOR THE PAPER LOADING INTO THE PRINTERS.

And, another possible U.S. patent application may be filed which may be of interest is entitled: THERMAL PRINTER HEAD WITH PRINT CONTROL DEVICE which is based on European Patent Application 07425198.4, Filed: Apr. 3 2007, and is available from the European Patent System.

LIST OF REFERENCE NUMERALS

1. curved door or movable element
2. pins
3. paper roll
4. printing device
5. cutting device
6. paper exit
7. paper portion removed from roll
8. frame cone and under portion of doors
9. spring or springs
10. fixing means (not in FIG. 1—see FIG. 6)
11. switch
12. cable
13. sensor instead of Switch 11—FIG. 7; FIG. 5 Switch 11

DESCRIPTION OF PREFERRED EMBODIMENTS

Figure 1:
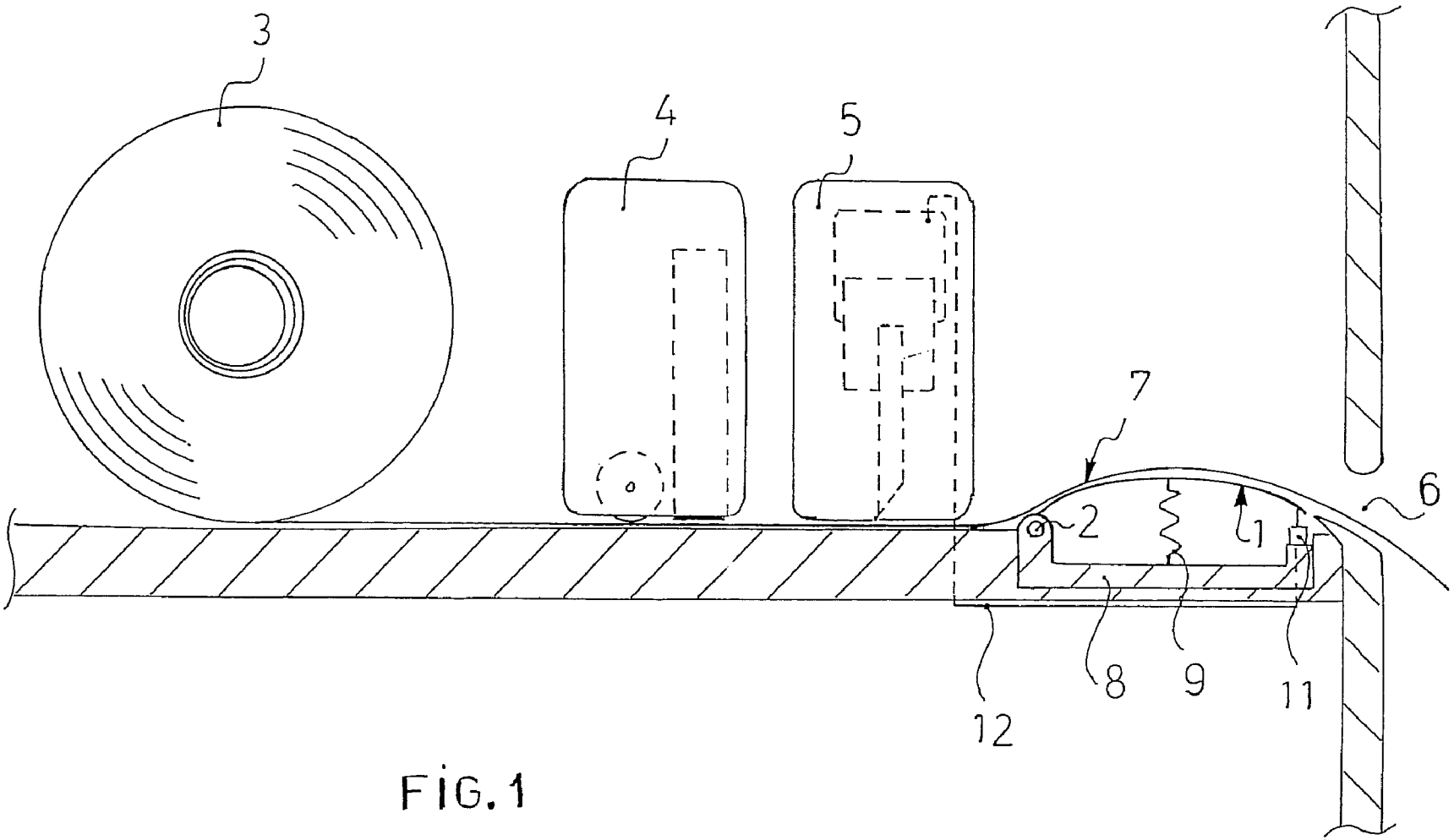
FIG. 1 is a schematic view in transverse section of the components of the apparatus including the limiting device in accordance with one embodiment of the invention and illustrating one condition of operation of the invention in which the limiting device is in its normal working condition, and illustrating the printing apparatus in its normal printing phase or just prior to the time a printed label or ticket or voucher is to be cut.

Referring now more particularly to the accompanying drawings which illustrate the best mode of carrying out the invention, as will be evident from the detailed description, like reference numerals refer to like parts in all embodiments.

As noted heretofore, the device is concerned with a ticket dispensing apparatus, which is provided with a paper sensitive element, such as a movable element or pivotal curved door 1, which is movable or pivotable about pivots or connector pins 2 and includes a conventional paper dispensing roll 3 conventionally supported for dispensing paper from the paper roll 3 onto which tickets are to be printed. Paper roll 3 is supported for rotation on a conventional axle and having its free end shown at paper exit 6.

A printing device 4 is provided juxtaposed to the paper dispensing roll 3 for printing tickets onto the paper dispensed from paper roll 3 and positioned between paper exit 6 and paper roll 3, after which the printed paper ticket is passed or moved to ticket cutting device 5 after passing printing device and positioned between printing device 4 and paper exit 6, and cut in response to an external signal transmitted to cutting device 4.

Door 1 is a curved member and has an outer curved shape or convex configuration and an inner concave shaped portion. Printed paper tickets after leaving or exiting from cutting device 5 are passed over or are transported over the convex outer portion of door 1. In the normal operation of the device, the ticket printing is automatically timed in accordance with the material to be printed and cut by conventional means after the appropriate length of the ticket is fully and completely printed in accordance with a conventional pre-set printing timing arrangement.

As noted in order to avoid the use of excess paper, the present invention provides for a limiting device which senses when door or movable element 1 is moved from its normal or inoperative position to its operative position in response to an outside source interfering with the dispensing of the tickets or when a ticket is completely printed in accordance with the pre-set printing timing arrangement to cut a complete and properly printed ticket. During normal operation, a printed cut ticket will exit through exit opening 6 and paper portion 7 which has moved beyond printing device 4, and a fully printed ticket as well as a partially or improperly printed ticket will then pass over the convex portion of door 1 to the exit opening. The operation of cutting device 6 is controlled in accordance with either the completion of the pre-set ticket operation or by the control performed by the door 1 in response to an improperly printed ticket forming part of the limiting device and as the door 1 moves from its normal or inoperative position to the door activation or operative position to cease the printing operation.

Door 1 is carried or supported by frame 8 and has a pair of spaced ends, one end being pivotable or rotatable about pins 2 or an axle and its second or free end opposite to the one end proximate to exit opening 6.

Positioned under door 1 and connected with the underside thereof or its concave portion is at least one spring 9 for urging door 1 in an upward direction to maintain door 1 in its normal or inoperative position or away from frame 8 and door 1 is provided to support paper dispensing roll 3, printing device 4 and cutting device 5.

Figure 5:
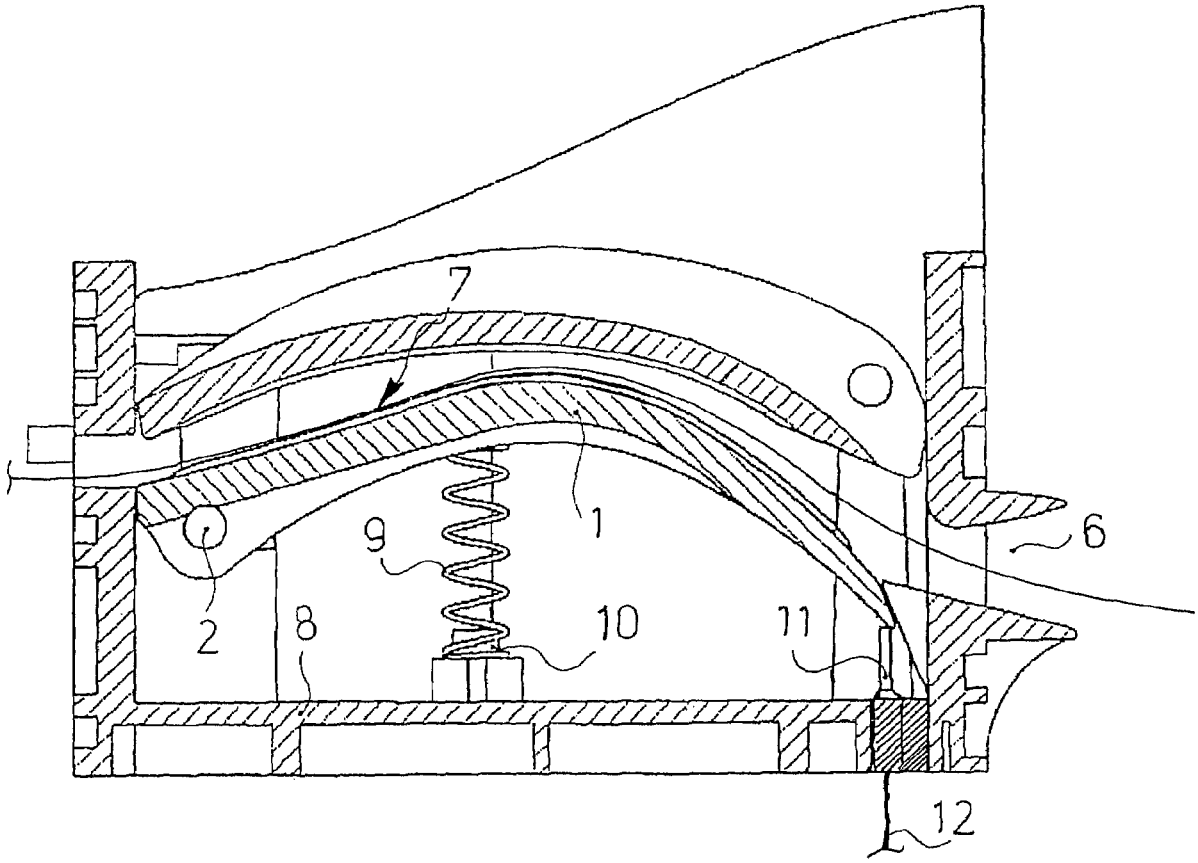
FIG. 5 is a longitudinal sectional view of the printing apparatus illustrating one embodiment of the limiting device of the invention in its working phase free of any tension applied to the paper or voucher at the exit opening of the apparatus in response to any traction or pulling by a user illustrating one condition of the printing apparatus.
Figure 7:
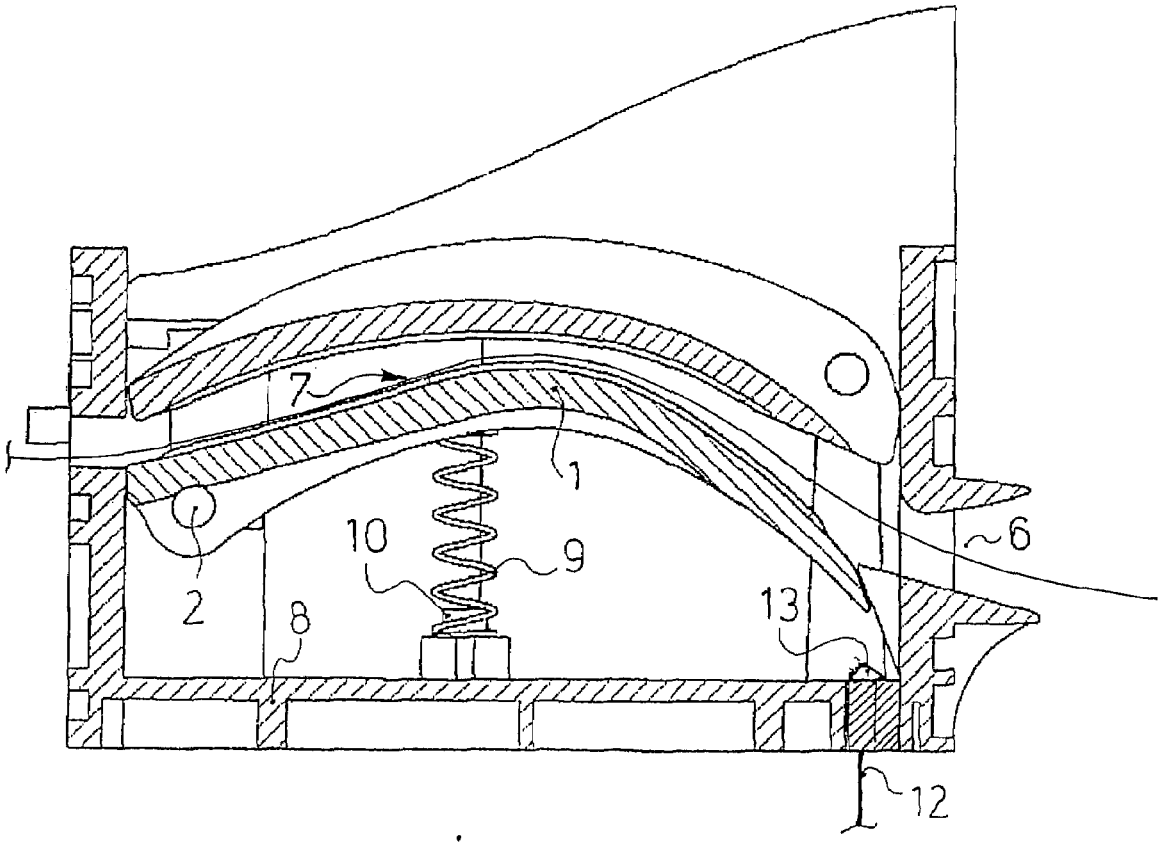
FIG. 7 is a longitudinal sectional view in normal working or operative phase of another embodiment of the printing apparatus provided with a sensor to activate the limiting device instead of a switch and positioned to be responsive to movement of the door or cover and responsive to a pulling of the ticket or paper voucher.

As best seen in FIGS. 5 and 7, a fixing or spring retention device 10 is provided for connecting one end of spring or springs 9 to the base of frame 8, the other end of spring 9 is connected or urged against and in contact with the underside or concave portion of door 1.

In the embodiment shown in FIGS. 1 to 6, switch 11 is provided and is responsive to door 1 being activated or moved to its operative position. Door 1 is activated or moved to its operative position in two ways; one way in which door 1 is activated is in response to paper 7 and in response to paper 7 exerting pressure onto the convex portion of door 1 to activate switch 11 which activates cutting device to cut paper 7 in response to door 1 being activated when the appropriate and complete printing onto paper 7 has taken place; and, the second way in which curved door 1 is activated or moved to its operative position is responsive to an outside source and specifically in response to an outside source causing door 1 to move in response to an obstruction at the paper exit 6 or someone pulling on paper ticket 1 too soon before the ticket is completely printed onto the paper dispensed from paper roll 3 or to an individual providing an obstruction or occlusion at exit opening or paper exit 6. Cable 12 is connected with switch 11 in response to switch 11 being activated to effect an immediate cutting of the improperly printed ticket.

In the other embodiment, as shown more specifically in FIG. 7, switch 11 is replaced by sensor 13, which is placed in the same position as switch 11 as shown in FIGS. 1 to 6 and with the same connections and with the same work.

Description Of Operation

Figure 2:
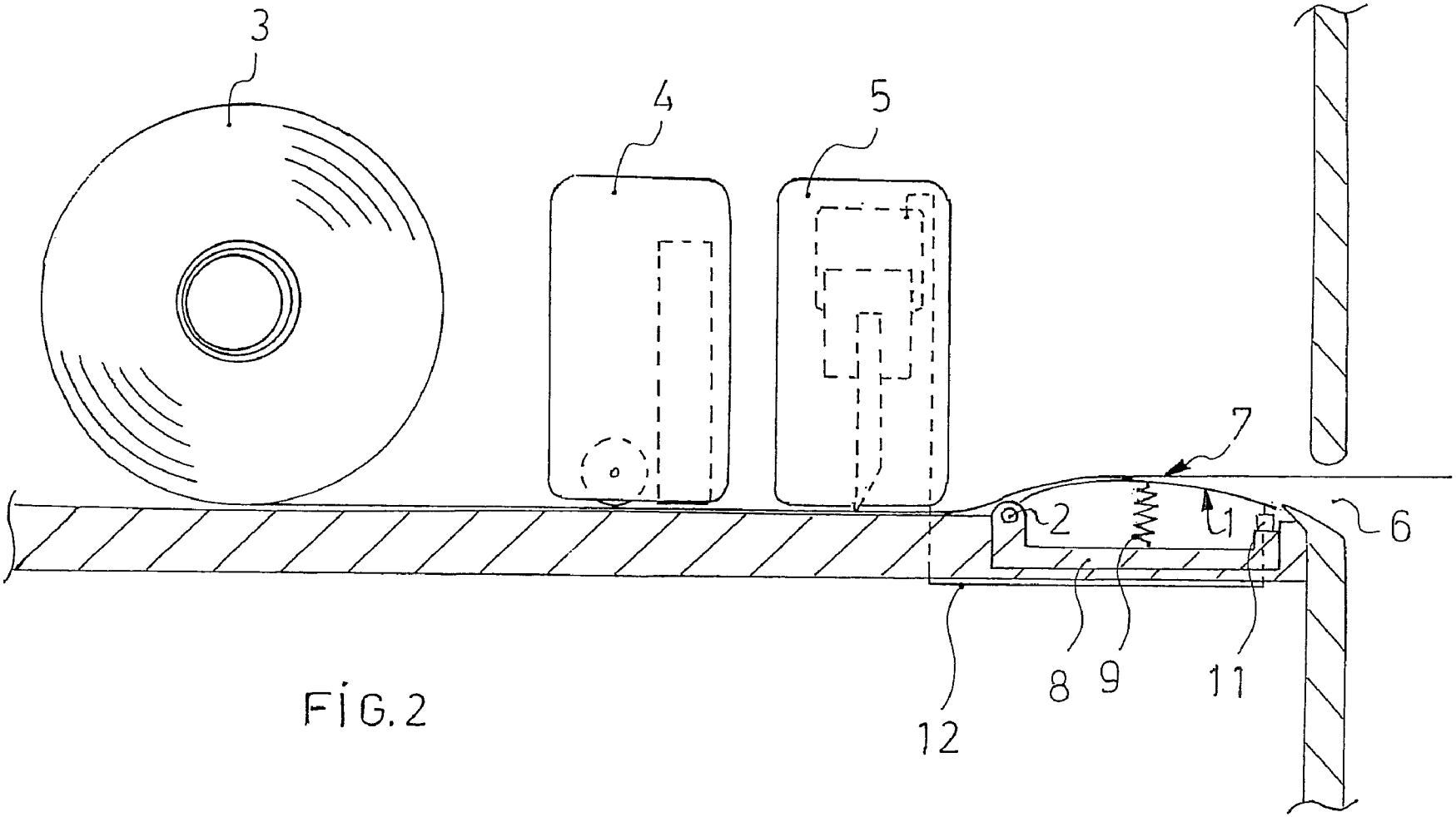
FIG. 2 is another schematic view also in transverse section and illustrating the printing components of the apparatus including the limiting device in its ticket or paper voucher cutting phase whether a ticket is to be cut either automatically in connection with the normal operation of the limiting device of the printing apparatus or when a paper roll for the supply of tickets or vouchers is cut in response to a lateral pull on a portion of the ticket exiting from the printing apparatus.
Figure 3:
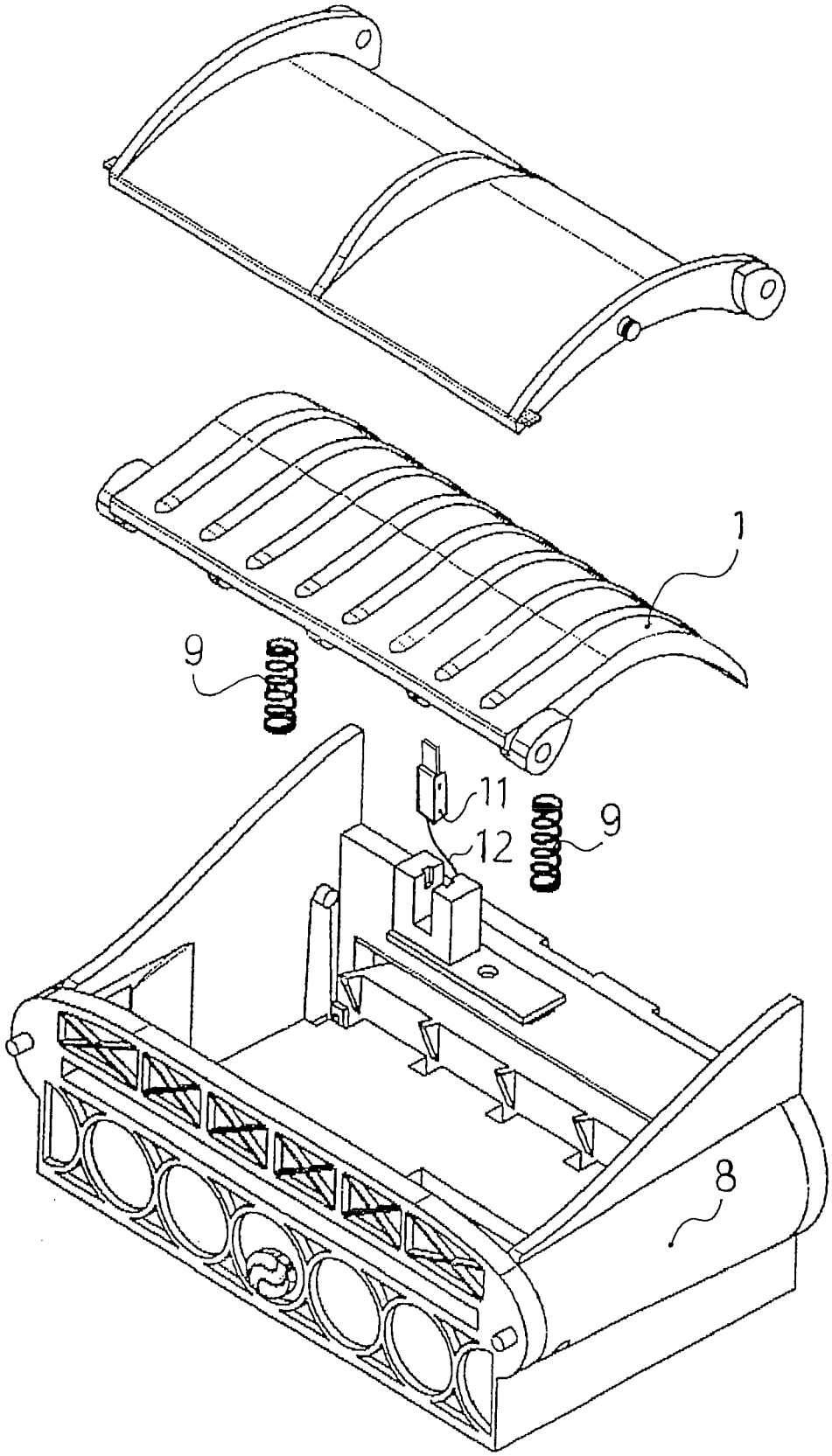
FIG. 3 is an exploded view of the printing apparatus illustrating all of the components thereof and including the essential portions of the limiting device according to the invention for all embodiments.
Figure 4:
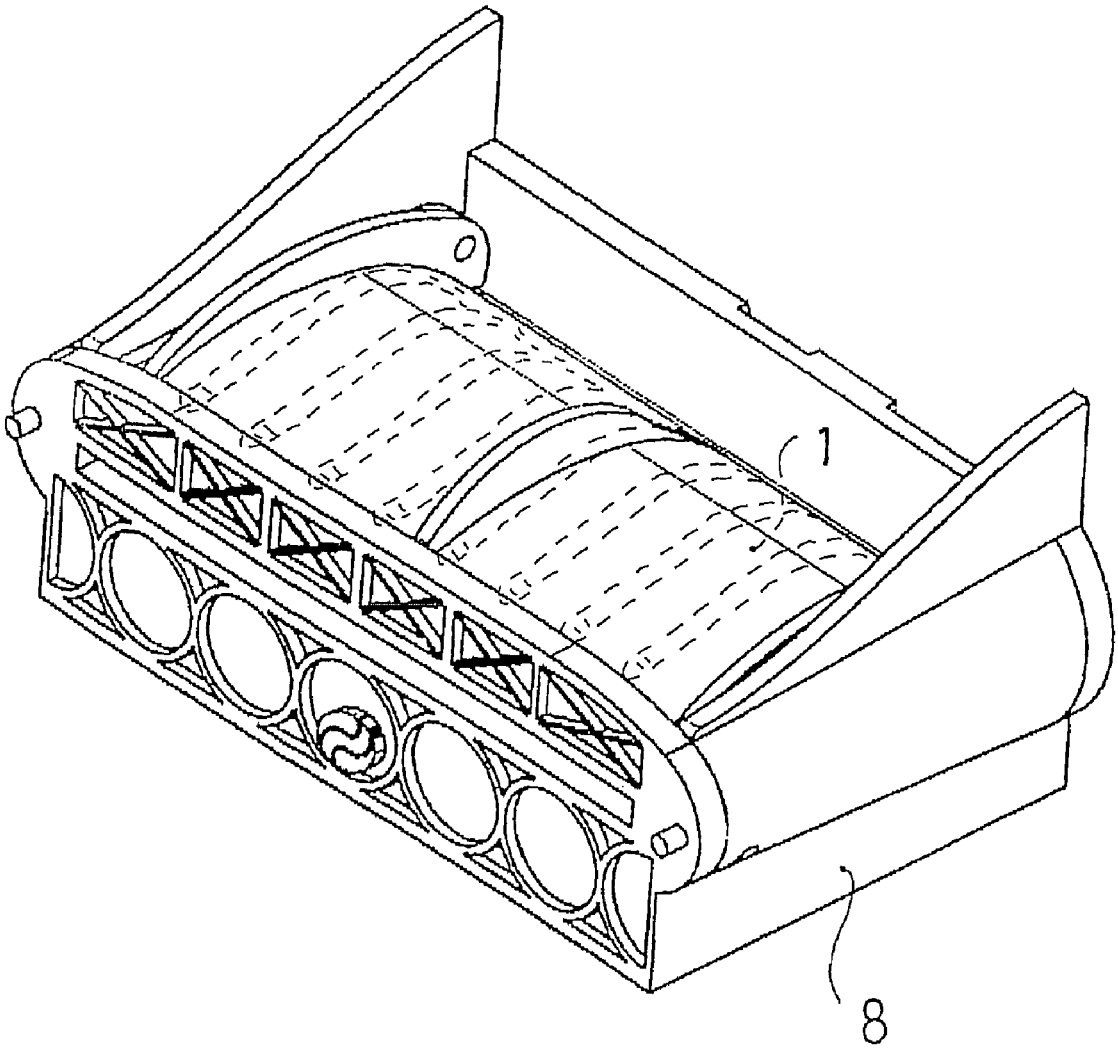
FIG. 4 is a perspective view of the assembled apparatus of FIG. 3 for all embodiments.

As will be evident from the drawings, FIG. 1 illustrates the normal working or operating condition of the apparatus or limiting device, i.e. without any interference of a user or another who pulls or pushes paper 7 while the paper the voucher is being printed and the printing apparatus is still in its printing phase or during the time just prior to the printed paper or voucher being cut by cutting device 5. FIG. 2 illustrates the apparatus during the working phase.

Figure 6:
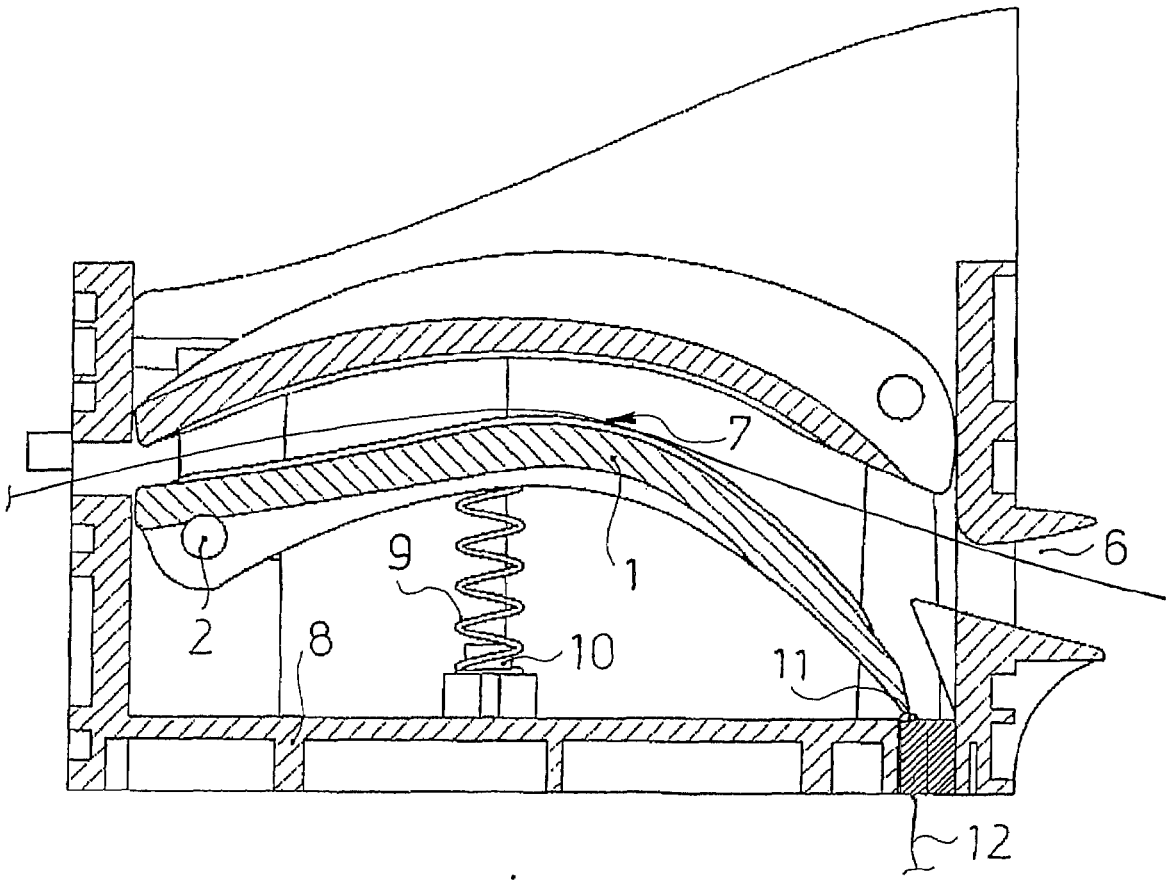
FIG. 6 is a longitudinal sectional view of the printing apparatus with the limiting device in its operable position to prevent the printing apparatus from operating and movement of the paper and printing thereon and with the components stressed in response to activation of the limiting device or responsive to an external pull onto the paper which interferes with the normal operation of the apparatus for all embodiments of the invention.

FIG. 5 is a view of the working phase of the apparatus without tension being applied to the paper or to any paper traction; and FIG. 6 shows the components of the apparatus stressed or the door moved in response to any outside activation source which can interfere with the printing operation.

During the operation, in the case of a removal of the voucher or paper during the printing phase or immediately thereafter, tension is applied to the paper which is due to exertion applied to the paper by a user or another who pulls the paper outwardly in advance of or prior to the completion of the phase in which the cutting device is responsive to an impulse or signal from the printing device or at any time between the printing and the cutting of the paper ticket or voucher, the curved door 1 is lowered into its deactivation position from its activation position, movement of paper 1 ceases and jamming in the apparatus is prevented. In this position, spring or springs 9 are compressed and stressed in response to activation of switch 11, and cutting device 5 is immediately started by means of an impulse or signal transmitted by means of or through cable 12. In this way, a printed paper or voucher is cut when it is incorrectly pulled at the exit or any other interference takes place, thereby avoiding an excess use of paper and jamming, and only the improperly printed voucher or paper is wasted.

In fact, it occurs that when the user of the roll printer pulls the paper, in advance in comparison with the pre-determined controlled phases, the lowering of the curved door 1 is maintained in its normal position by springs 9 until switch 11 is responsive to the movements of the door 1, for activation of the cutting device 5.

As noted from the aforesaid, the present invention has provided a novel and improved limiting device for limiting removal of paper from a paper or paper ticket printing apparatus provided with roll printers having no use for electric motors, rolls, an electronic clutch or sensors connected to retroaction systems, and which includes the curved door 1 which is pivotable around the pair of pins or other fixing means 2 and positioned on the frame 8, and the fixing means is provided for connecting the curved door 1 to the frame 8 which is equipped with underlying springs 9, connected to the frame 8. The curved door has near its free part or end means for permitting rotation or imparting rotation thereto. Switch 11 is positioned on the frame 8 and in contact with the curved door 1. Cable 12 is provided for connecting switch 11 to cutting device 5 for cutting of the printed ticket or a voucher in response to a change in tension of the paper 7 due to an occlusion or interference at the exit opening, whether due to a pulling action onto the paper or due to a prevention or blockage to stop the paper from exiting from the exit opening.

The limiting device also includes the sensor 13 as an alternative to the switch 11 and is positioned on the frame for activation of the cutter.

While there has been shown what is considered to be the best mode for carrying out the invention, it will be obvious to those skilled in the art that various changes and modifications may be made without departing from the scope of the invention.

The invention claimed is:

1. Apparatus for preventing unwanted removal of paper from a paper or paper ticket printing and dispensing apparatus for paper roll printers or responsive to an incompletely printed paper ticket due to an occlusion, wherein said apparatus is provided with:

a paper roll for paper or providing the paper onto which printing is to take place, said apparatus including a ticket or paper dispensing exit having an opening for dispensing a completely printed ticket or paper and means for feeding paper from said paper roll to said ticket or paper dispensing exit;

a paper or ticket printer positioned between said paper roll and said ticket or paper dispensing exit for printing the ticket;

a paper or paper ticket cutter positioned between said paper or ticket printer and said ticket or paper dispensing exit for cutting the paper onto which ticket information is printed for forming thereof into individual tickets or vouchers;

a paper cutter actuating means and paper feeding means positioned between said ticket or paper dispensing exit and said paper ticket cutter for activation thereof to cut said paper onto which printing has taken place, and for controlling feeding of the paper from said paper roll and said paper or ticket printer and for controlling operation of said paper or ticket printer, said activation of said paper or paper ticket cutter to cut the paper being activated in response to either an incompletely printed ticket or in response to an action externally of said apparatus when there is either an occlusion or other interference at said ticket or paper dispensing exit for preventing said paper from exiting from said ticket or paper dispensing exit to prevent withdrawing the paper or pulling of a partially printed ticket or paper prior to completion of any printing onto said ticket or paper at the dispensing exit opening and in response to pre-setting of time for cutting a completely and correctly printed ticket or paper;

said paper cutter actuating means including a movable member associated with said paper or paper ticket cutter to cut a partially or incompletely printed ticket movable from a first or deactivation position at which said paper or paper ticket cutter does not cut the paper ticket or paper to a second or activation position to render said paper or paper ticket cutter operable for cutting the partially or incompletely printed paper ticket or paper in response to said external interference with the paper or ticket at said exit opening; and said paper cutter actuating means also being responsive to a completion of a completely and correctly printed ticket in accordance with the pre-set time for a complete ticket printing operation in response to completion of an intended printing onto the paper ticket for cutting the completely printed paper ticket having the completed intended printing thereon to cut or sever the printed ticket from the paper roll whereby to permit and provide withdrawal of the completely printed ticket or voucher paper, after the ticket or paper is cut by said paper or paper ticket cutter, from said exit opening.

2. The apparatus as claimed in claim 1, wherein an activation means includes a pivotable door member having a pair of spaced ends, a first of said spaced ends being a free end and positioned at said exit opening and a second of said spaced ends being pivotally connected to a frame of said apparatus and positioned between said exit opening and proximate to said paper or ticket cutter, said pivotable door member being pivotable and movable relative to said frame of said dispensing apparatus for said deactivation of said paper or paper ticket cutter, signal forwarding means for sensing a signal in response to said external interference at said exit opening to send a signal to said paper or ticket printer to stop printing onto said paper and to activate said paper or paper ticket cutter to cut the ticket before the ticket or paper has been fully and completely printed to prevent bunching of paper from said paper roll or a partially printed ticket at the exit opening.

3. The apparatus as claimed in claim 2, wherein said signal forwarding means includes a switch activated in response to said pivotal door member being moved and pivoted in a direction relative to said switch for activation thereof, and said switch upon activation forwards a signal through said signal forwarding means to said paper or ticket cutter for activating said paper or ticket cutter to render said paper or ticket cutter operative for cutting said partially printed paper or ticket and deactivation of said paper feeding means when complete printing onto said ticket or paper has taken place.

4. The apparatus as claimed in claim 2, wherein said signal forwarding means includes a sensor responsive to movement of said pivotable door member to deactivate said printing device and to activate said paper or ticket cutter to cut said paper or partially printed ticket.

5. The apparatus as claimed in claim 2, including spring holding means having one end connected with said frame and another end fixed to an underside of said pivotable door member for maintaining said pivotable door member in a non-activating or non-operating position, and said spring holding means being responsive to the external interference with said paper at said exit opening during operation of a ticket printing operation as a partially printed ticket passes over said pivotable door member moving towards said exit opening overcoming said spring tension or pulling on the underside of said door pivotable member to permit movement of said pivotable door member to its fully extended position for activation of said signal forwarding means to deactivate said paper feeding means and to stop said paper or ticket printer and to sever the paper of the partially printed ticket, thereby preventing bunching of paper at said exit opening.

6. The apparatus as claimed in claim 2, including a cable coupled with said signal forwarding means and said paper or ticket printer and said paper or ticket cutter for transmitting the signal to said paper or ticket printer and to said paper or ticket cutter upon activation in response to the movement of said pivotal door member when said spring holding means causes said pivotable door member to be pivotable upon release of a tension or pulling placed onto said pivotable door member.

7. The apparatus as claimed in claim 2, wherein said pivotable door member is an external arm cover forming part of said apparatus.

8. The apparatus as claimed in claim 1, including signal means, responsive to said external interference at said exit opening, for sensing a signal and for sending another signal to paper or ticket printer to stop said paper or ticket from printing onto said paper and for activating paper or ticket from cutting the ticket before the ticket or paper has been fully and completely printed for preventing bunching of the paper from said paper roll at the exit opening during a continuing operation of the paper or ticket.

9. The apparatus as claimed in claim 1, wherein said movable member is a pivotable door member providing for an external arm cover for said apparatus.

10. The apparatus as claimed in claim 1, including a cable coupled with a signal forwarding means and said paper or ticket printer and said paper or ticket cutter for transmitting a signal to said paper or ticket printer and to said paper or ticket cutter upon activation in response to the movement of said pivotable door member when said spring holding means causes said pivotable door member to be pivoted upon release of tension or pulling placed onto said pivotable door member by causes external of said apparatus.

11. The apparatus as claimed in claim 1, including a switch activated in response to said movable member being moved and pivoted in a direction relative to said switch for activation thereof, and said switch upon activation forwards a signal to said paper or ticket cutter and said paper or ticket printer for activating said paper or ticket cutter to render said paper or ticket cutter operative for cutting said partially printed paper or ticket and deactivation of said paper feeding means.

12. The apparatus as claimed in claim 1, including a sensor responsive to movement of said movable member to deactivate said paper or ticket printer and to activate paper or ticket cutter to cut said paper or partially printed ticket.

13. The apparatus as claimed in claim 1, including spring holding means having one end connected with a frame of the apparatus and another end fixed to an underside of said movable member for maintaining said movable member in a non-activating or non-operating position, and said spring holding means being responsive to the external interference with said paper at said exit opening during operation of the ticket printing operation as a partially printed ticket passes over said movable member moving towards a ticket printing operation exit overcoming a spring tension or pulling on the underside of said movable member to permit movement of said movable member to its fully extended position for activation of a signal forwarding means to deactivate said paper feeding means and to stop said paper or ticket printer and to sever the paper of the partially printed ticket, thereby to prevent bunching of paper at said exit opening.

14. Apparatus as claimed in claim 1, including: a curved door forming part of said movable member; fixing means for said curved door, said curved door having one end connected to a frame for associating said curved door with said frame and being equipped with underlying springs, connected to said frame; said curved door having its other end forming a free part and cooperating with said paper or ticket cutter and paper feeding means responsive to movement or rotation of said curved door about a pair of pins at said one end; a switch positioned on the frame and in contact with said curved door; and a cable for connecting said switch to said paper or ticket cutter for cutting of the printed ticket in response to tension of the paper.

15. The apparatus according to claim 14, including a sensor positioned on said frame for activation of said paper or ticket cutter.

* * * * *